US008341912B2

(12) United States Patent
Verna et al.

(10) Patent No.: US 8,341,912 B2
(45) Date of Patent: Jan. 1, 2013

(54) DECORATIVE PLASTIC BATTEN SHUTTER

(76) Inventors: Donald Verna, Wixom, MI (US); Richard C. Kruyer, Swartz Creek, MI (US)

( * ) Notice: Subject to any disclaimer, the term of this patent is extended or adjusted under 35 U.S.C. 154(b) by 841 days.

(21) Appl. No.: 12/361,559

(22) Filed: Jan. 29, 2009

(65) Prior Publication Data

US 2010/0058698 A1 Mar. 11, 2010

Related U.S. Application Data

(60) Provisional application No. 61/095,768, filed on Sep. 10, 2008.

(51) Int. Cl.
*E04B 9/00* (2006.01)

(52) U.S. Cl. ..... 52/473; 52/202; 52/204.61; 49/74.1

(58) Field of Classification Search ..... 52/202, 52/203, 204.61, 473, 633, 667, 656.7; 49/74.1, 49/92.1

See application file for complete search history.

(56) References Cited

U.S. PATENT DOCUMENTS

| | | | | |
|---|---|---|---|---|
| 5,617,688 | A | 4/1997 | Gandy et al. | |
| 5,996,298 | A * | 12/1999 | Wenzlaff et al. | 52/473 |
| 6,122,875 | A | 9/2000 | Schiedegger et al. | |
| 6,374,560 | B1 * | 4/2002 | Schiedegger et al. | 52/475.1 |
| 6,968,656 | B2 | 11/2005 | Schiedegger et al. | |
| 7,296,383 | B2 | 11/2007 | Schiedegger et al. | |

* cited by examiner

*Primary Examiner* — William Gilbert
(74) *Attorney, Agent, or Firm* — Young Basile Hanlon & MacFarlane, P.C.

(57) ABSTRACT

A decorative shutter assembly including a plurality of main slats arranged in side-by-side relation, end pieces positioned at each end of the main slats and each including laterally spaced tongues spaced and sized to fit in their respective open ends of the main slats at a respective end of the main slats, and cross slat structures positioned in overlying relationship to seams formed between inboard ends of the end pieces and the respective ends of the main slats. The cross slat structures are removably secured to the end pieces and to the main slats so that, following delivery of the shutter assembly to a building site, the cross slat structures may be removed, the end pieces and main slats may be secured to a building surface utilizing fastener members, and the cross slats may be repositioned over the fastener members to conceal the fastener members.

30 Claims, 7 Drawing Sheets

DECORATIVE PLASTIC BATTEN SHUTTER

CROSS-REFERENCE TO RELATED APPLICATIONS

This application is related to and claims priority to U.S. Provisional Patent Application No. 61/095,768 filed Sep. 10, 2008.

FIELD OF THE INVENTION

This invention relates to shutters and more particularly to a decorative plastic batten shutter.

BACKGROUND

Decorative building panels such as shutters are widely used in the building industry to add decor to a house or other type of building structure. A popular type of building panel that is used is a window shutter. Window shutters, which are typically not functional, present a decorative façade that gives the appearance of being a functional shutter.

One popular style of shutter is commonly referred to as a batten shutter. The batten shutter includes a plurality of batten slats arranged vertically in a row. At least one, and usually two, cross slats overlay each of the batten slats. The cross slats adjoin the batten slats forming the batten shutter assembly. A simulated plastic batten shutter commonly includes slats having a decorative surface and flanges projecting rearwardly from the surface creating a hollow slat that gives the appearance of being a complete wooden slat. While the plastic materials reduce the cost of the batten shutter, manufacturing the shutters and mounting the shutters on a housing surface are labor-intensive and costly operations.

SUMMARY

An improved decorative plastic batten shutter that can be inexpensively manufactured and readily mounted on a building surface is described herein.

An exemplary decorative shutter assembly includes a plurality of vertical main slats arranged parallel to each other in side-by-side relation, presenting a decorative surface, with each main slat defining an open end at each of its ends. A first end piece is positioned at one end of the main slats, and a second end piece is positioned at an opposite end of the main slats. Each end piece includes a main body section having a width approximating the overall width of the side-by-side slats and a plurality of laterally spaced tongues projecting from an inboard end of the main body section. The main body section of each end piece presents a decorative surface, and the tongues are spaced and sized to fit in the respective open ends of the main slats at a respective end of the main slats with the decorative surfaces of the main body section positioned flush with the decorative surfaces of the main slats to form a continuous, flat decorative surface extending from end to end of the shutter.

According to another example of the decorative shutter assembly, the main body section of each end piece defines end slat portions aligning respectively with the side-by-side main slats.

In yet another example, the main slats are substantially contiguous and the end slat portions of each end piece are defined by parallel, laterally spaced grooves opening in the decorative surface of the main body section and aligning respectively with seams formed between the substantially contiguous main slats to create the appearance of slats extending from end-to-end of the shutter.

In still another example, the main slats are laterally spaced and the end slat portions of each end piece comprise separate laterally spaced slat portions aligning respectively with the laterally spaced main slats.

According to a further example, the shutter assembly further includes first and second cross slat structures with each cross slat structure secured to a respective main body section of an end piece and to respective ends of the main slats in overlying relation to a seam formed between the inboard end of the main body section and the respective ends of the main slats.

According to an additional example, each cross slat structure includes a cross slat having a U-shaped cross-sectional configuration including a first side flange portion positioned against the respective ends of the main slats, a second side flange portion positioned against the main body section of the respective end piece, and a main body portion spaced above the decorative surfaces of the main slats and the decorative surface of the main body section of the end piece and presenting a decorative surface complementary to the decorative surfaces presented by the main slats and the main body section of the end piece.

According to still another example, each cross slat structure further includes a plurality of spaced fastener pins extending rearwardly from the main body portion of the cross slat and engaging the main body portion of the respective end piece and the respective ends of the main slats to connect the end pieces to the main slats.

According to a further example, the plurality of fastener pins of each cross slat structure includes a plurality of laterally spaced fastener pins coacting with laterally spaced apertures in the main body section of the respective end piece and a further plurality of laterally spaced fastener pins coacting with apertures in the ends of laterally spaced main slats and with aligned apertures in the laterally spaced tongues received in the laterally spaced main slats.

According to another example, the main body section of each end piece includes a main body portion presenting the decorative surface and side flange portions projecting rearwardly from the main body portion and, with the tongues fitted in the respective open ends of the main slats, the outboard side flanges of the outboard main slats align with the side flanges of the end pieces to constitute continuous side flanges extending from end to end of the shutter.

According to yet another example, each cross slat has open ends; and each cross slat structure further includes end caps fixedly positioned in the open ends of the cross slats and defining the fastener pins.

According to still another example, the decorative shutter assembly includes a vertical shutter structure and a plurality of cross slats extending laterally across the vertical shutter structure; the vertical shutter includes fastener apertures to pass fastener members to secure the vertical shutter structure to a building surface; and the cross slats extend laterally across the vertical shutter structure in overlying and concealing relation to the fastener members.

According to an additional example, the shutter assembly further includes coacting fastener structures on the vertical shutter structure and the cross slats operative to removably secure the cross slats to the vertical shutter structure, thereby allowing removal of the cross slats to allow passage of the fastener members through the apertures to attach the vertical shutter structure to the building surface followed by reattachment of the cross slats to the vertical shutter structure to conceal the fastener members.

According to another example, the coacting fastener structures include resilient pins on the cross slats and pin apertures in the vertical shutter structure.

According to a further feature of the invention, the fastener apertures comprise vertically extending slots to provide adjustment in the mounting of the vertical shutter structure on the building surface.

Also described herein is a method, for use with a decorative shutter including a vertical shutter structure and a plurality of cross slats, of attaching the shutter to a building surface. An example of the method comprises securing the vertical shutter structure to the building surface utilizing fastener members and positioning the cross slats over the fastener members to conceal the fastener members.

According to another example of the methodology, the cross slats are removably secured to the vertical shutter structure and the method comprises removably securing the cross slats to the vertical shutter structure; when ready for attachment to a building surface, removing the cross slats from the vertical shutter structure; thereafter securing the vertical shutter structure to the building surface utilizing the fastener members; and thereafter replacing the cross slats to conceal the fastener members.

According to yet another example of the methodology, the vertical shutter structure includes a plurality of side-by-side vertical slats and upper and lower end pieces; upper and lower ends of the vertical slats are secured to the upper and lower end pieces, respectively; and the step of securing the vertical shutter structure to the building surface comprises securing the upper and lower end pieces to the building surface utilizing fastener members passing through the end pieces.

According to still yet another example of the methodology, an upper seam is formed between the upper ends of the vertical slats and a lower edge of the upper end piece and a lower seam is formed between the lower ends of the vertical slats and an upper edge of the lower end piece and the step of replacing the cross slats comprises positioning an upper cross slat in overlying and concealing relation to the upper seam and to the fastener members securing the upper end piece to the building surface and positioning a lower cross slat in overlying and concealing relation to the lower seam and to the fastener members securing the lower end piece to the building surface.

According to an additional example of the methodology, the step of removably securing the cross slats to the vertical shutter structure comprises providing resilient pin structures on each cross slat and resiliently passing the pin structures through apertures in the vertical shutter structure.

Other applications of the decorative shutter assembly will become apparent to those skilled in the art when the following description of the best mode contemplated for practicing the invention is read in conjunction with the accompanying drawings.

BRIEF SUMMARY OF THE DRAWINGS

The description herein makes reference to the accompanying drawings wherein like reference numerals refer to like parts throughout the several views and wherein.

DETAILED DESCRIPTION OF THE PREFERRED EMBODIMENT

Figure 1:
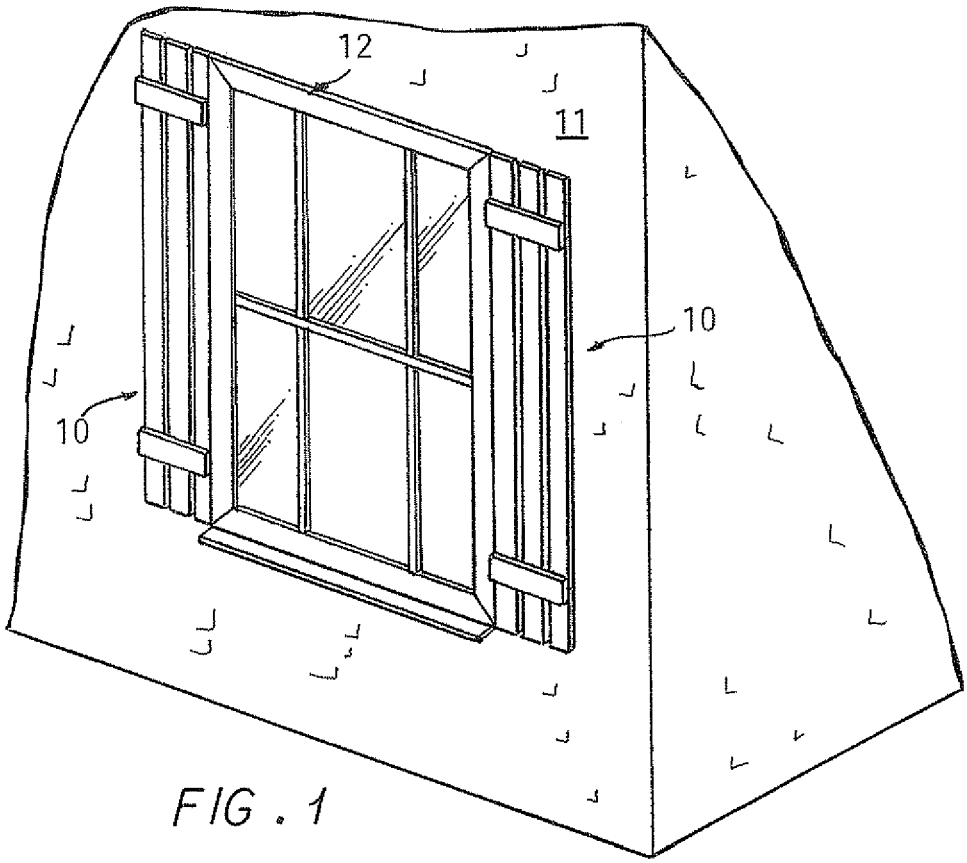
FIG. 1 is a fragmentary perspective view showing an example of a shutter assembly applied to a building surface.

The shutter assembly 10 as described herein can be used as a decorative shutter and may, as seen in FIG. 1, be applied in pairs to a building surface 11 at opposite sides of a window 12 of a building structure.

Figure 2:
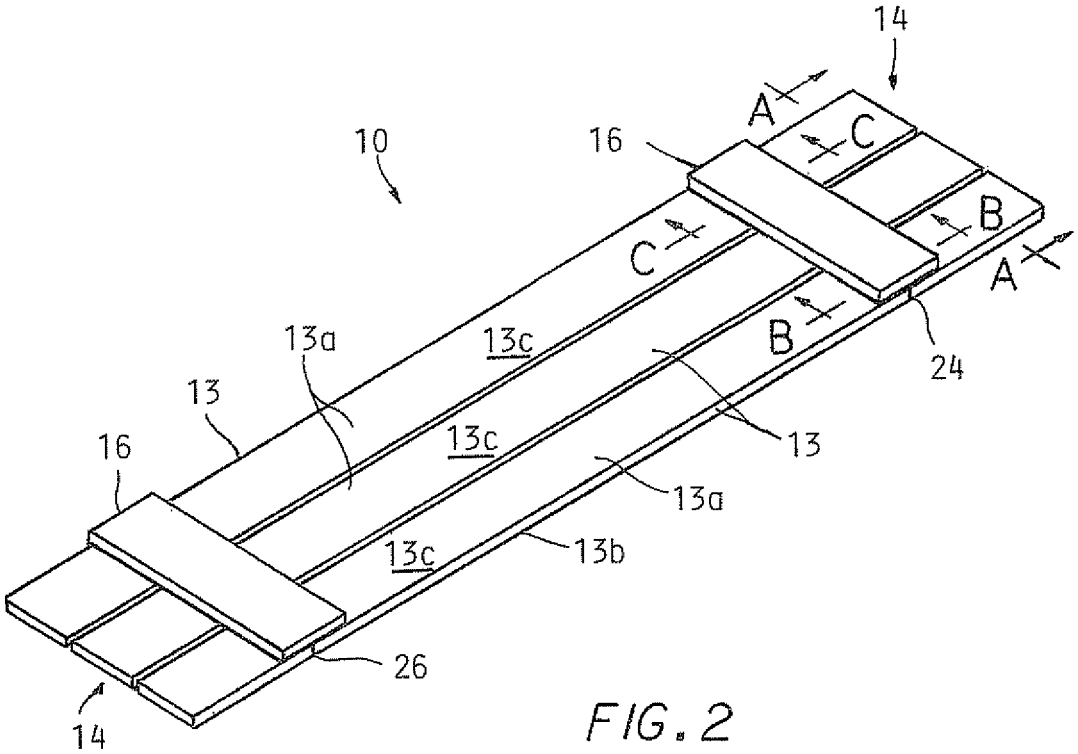
FIG. 2 is a perspective view of the shutter assembly of FIG. 1.

Shutter assembly 10, broadly considered, includes a plurality of elongated main batten slats 13, upper and lower end pieces 14, and cross slat structures 16 as shown in FIG. 2. Each batten slat 13 is preferably formed in a plastic extrusion process from polypropylene or a like material. The material may be formed in a variety of colors including ultraviolet absorbents to prevent fading and warping due to UV damage.

Figure 3:
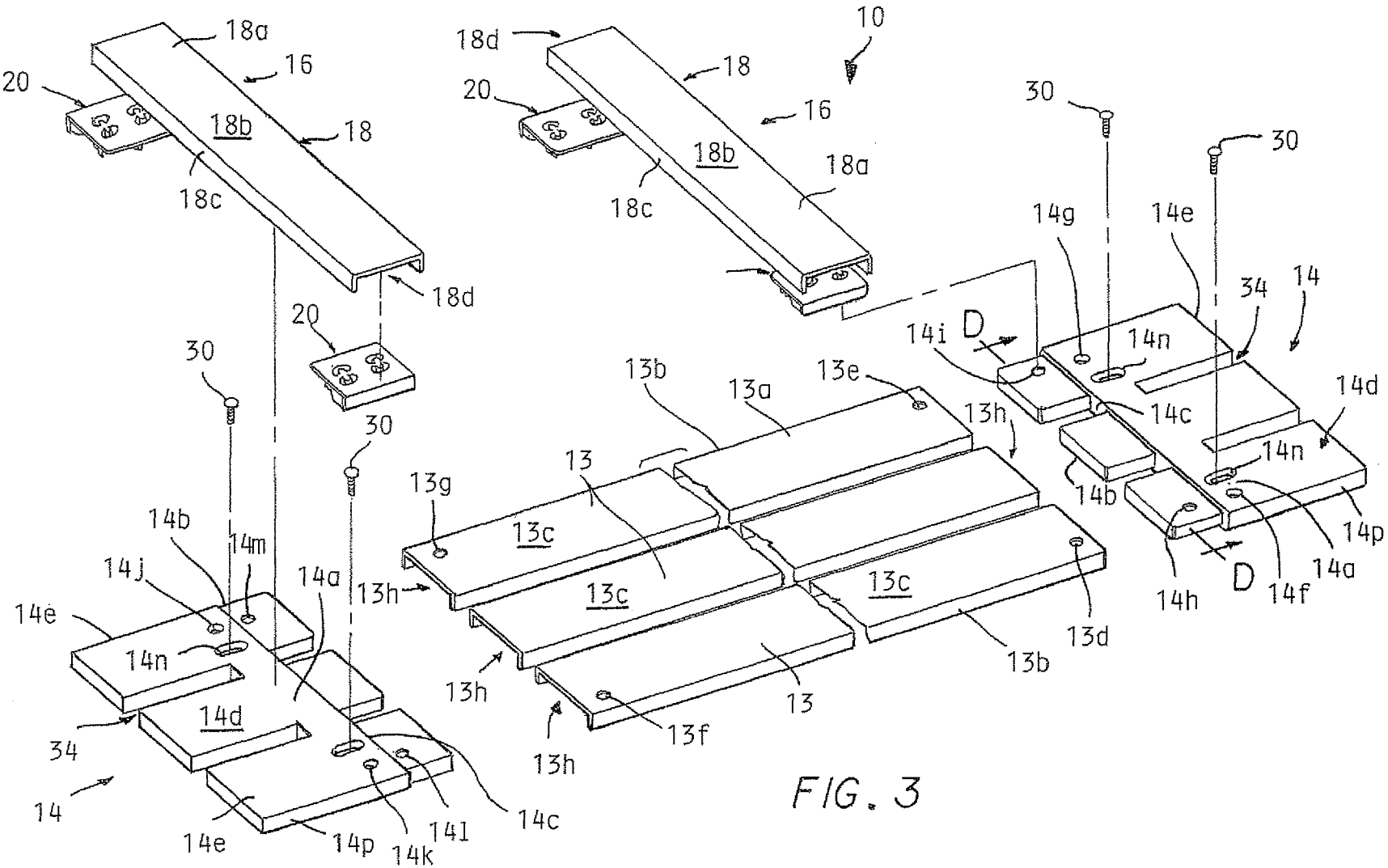
FIG. 3 is an exploded view of the shutter assembly of FIG. 1.

Each batten slat 13 has a U-shaped cross-sectional configuration as shown in FIG. 3 including a main body portion 13*a* and side flange portions 13*b* projecting rearwardly from the main body portion 13*a* and coacting with the main body portion 13*a* to define open ends 13*h* at each ends of the slat 13. A top side of each main body portion 13*a* can include a decorative surface 13*c*, and the side flange portions 13*b* can be similarly decorated.

Figure 15:
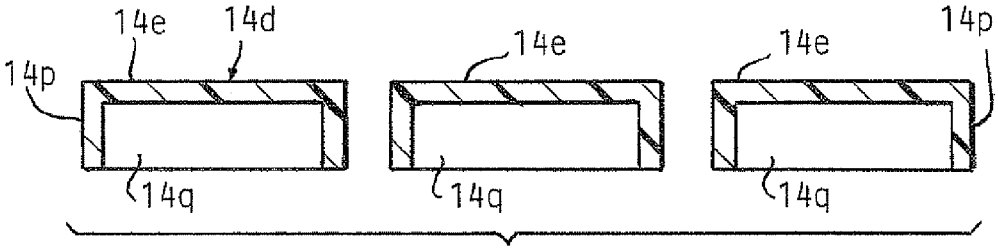
FIG. 15 is a cross-sectional view taken on line A-A of FIG. 2.
Figure 16:
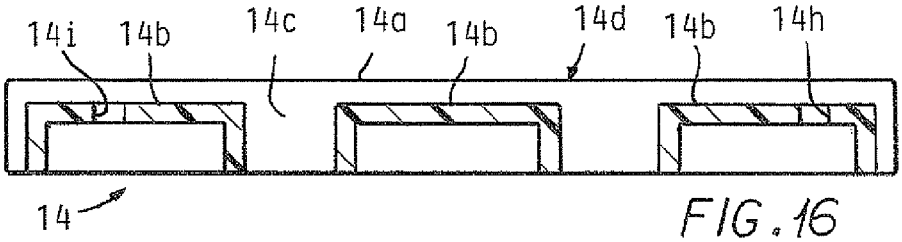
FIG. 16 is a cross-sectional view taken on line D-D of FIG. 3.
Figure 17:
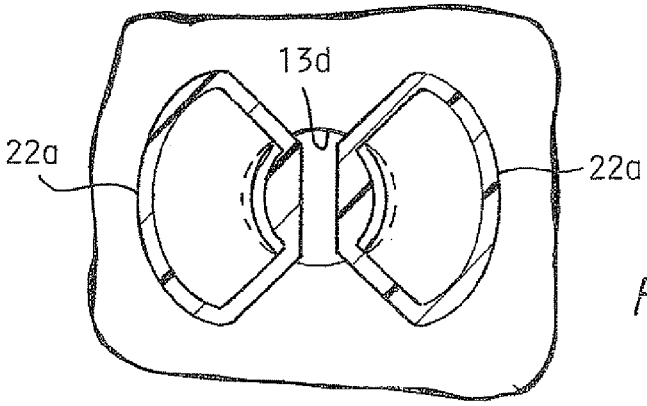
FIG. 17 is a cross-sectional view taken on line H-H of FIG. 11.

Each end piece 14, also shown in FIG. 3, includes a main body section 14*a* having a width approximating the overall width of the side-by-side slats 13 and a plurality of laterally spaced tongues 14*b* projecting from an inboard end 14*c* of the main body section. The tongues 14*b* are sized, spaced and configured to fit snugly into the respective open ends 13*h* of the main slats 13 at a respective end of the main slats 13 with decorative surfaces 14*d* of the main body sections 14*a* positioned flush with the decorative surfaces 13*c* of the main slats 13 to form a continuous flat decorative surface extending from end to end of the shutter 10 and with side flange portions 14*p* of the end pieces 14 aligned with and flush with the side flange portions 13*b* of the main slats 13 to constitute continuous side flanges extending from end to end of the shutter 10. The main body section 14*a* of each end piece 14 can further be configured to define a plurality of separate laterally spaced end slat portions 14*e* corresponding in number and cross-sectional configuration to the main slats 13, with each end slat portion 14*e* having an end wall 14*q* as shown in FIG. 15. End pieces 14 can be formed of the same material as the main slats 13.

Each cross slat structure 16 includes a cross slat 18 and a pair of end caps 20 as shown in FIG. 3. Cross slats 18 can have a cross sectional configuration corresponding to the cross sectional configuration of the main slats 13 and can be formed of the same material as the main slats 13. Specifically, each cross slat 18 includes a main body portion 18*a* defining a decorative surface 18*b* corresponding to the decorative surfaces 13*c* of the main slats 13 and side flange portions 18*c* extending rearwardly from the main body portion 18*a* and coacting with the main body portion 18*a* to define open ends 18*d* of the cross slat 18.

Figure 4:
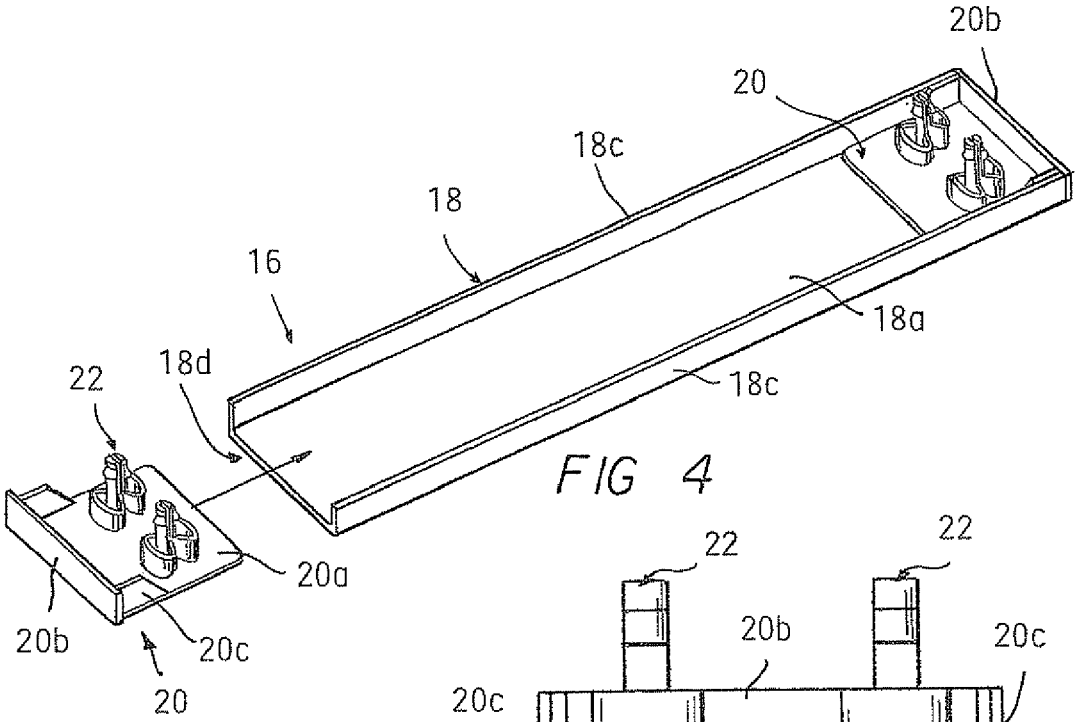
FIG. 4 is a partially exploded view of an example of a cross slat structure that can be utilized in the shutter assembly.
Figure 5:
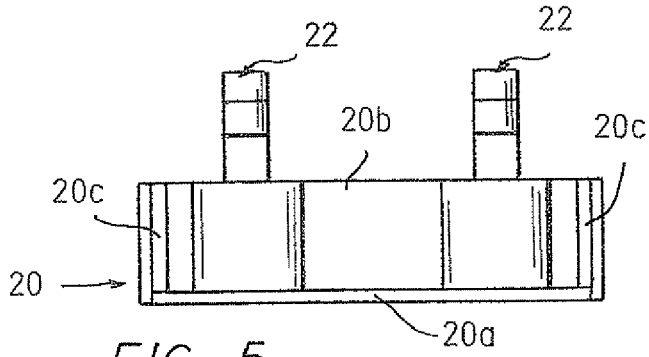
FIG. 5 is an side elevation view of an end cap that can be utilized in the cross slat structure.
Figure 6:
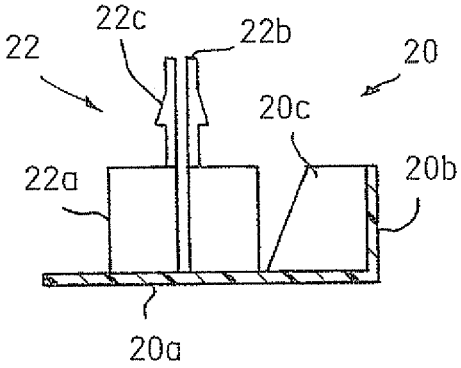
FIG. 6 is a cross-sectional view of the end cap of FIG. 5 taken on line E-E of FIG. 7.
Figure 7:
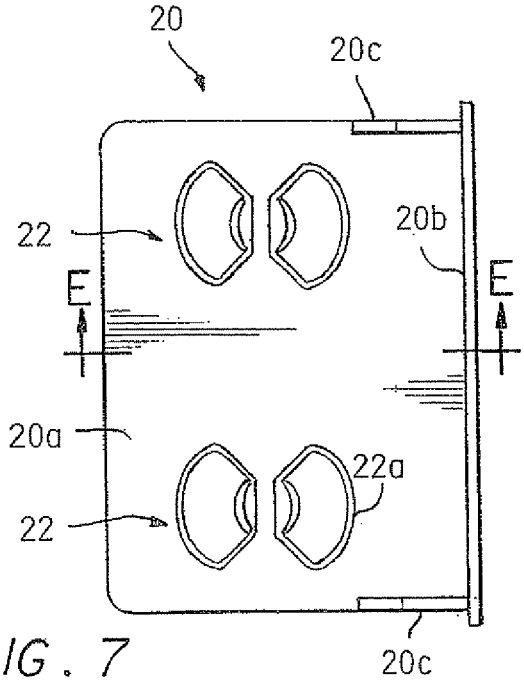
FIG. 7 is a plan view of the end cap of FIG. 5.

Each end cap 20 is sized to fit into an open end 18*d* of a cross slat 18 to close that end of the slat 18 as shown in FIG. 4. Each end cap 20 includes a base portion 20*a*, an end wall portion 20*b*, guide flange portions 20*c*, and a pair of tower structures 22 (which can also be referred to as "pin structures").

Figure 8:
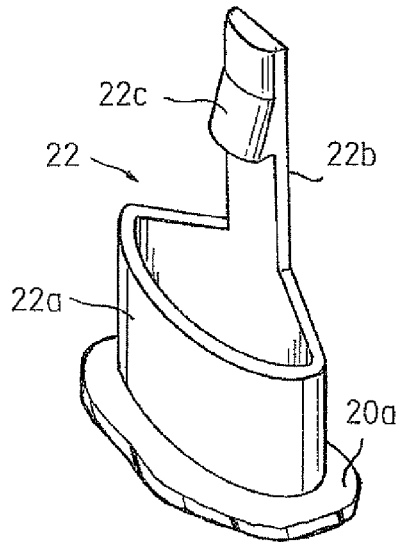
FIG. 8 is a fragmentary perspective view of a tower structure of the end cap of FIG. 5.

The tower structures 22 can be laterally spaced as shown in FIG. 4, and each tower structure 22 includes a hollow tower member 22*a* having a hollow, generally triangular cross-sectional configuration upstanding from base 20*a* and a finger 22*b* upstanding from the tower member 22*a* and defining a latch portion 22*c* as shown in FIG. 8. Tower member 22*a* has a vertical dimension corresponding to the vertical dimension of cross slat flange portion 18*c*.

As best shown in FIG. 3, in the assembled relation of the components of the shutter assembly 10, tongues 14*b* of end pieces 14 fit snugly into open ends 13*h* of main slats 13 and are sonically welded to the respective main slats 13. End caps 20 are positioned in the respective ends of each slat 18 and are sonically welded in place with the end walls 20*b* of the end caps 20 forming end walls of the cross slat structure 16 and with tower structures 22 extending downwardly and rearwardly from the main body portion 18*a* of the cross slat 18. A first cross slat structure 16 is positioned over a seam 24 shown in FIG. 2 formed at the intersection of the upper ends of main slats 13 and the inboard edge 14*c* of the upper end piece 14. Referring again to FIG. 3, the slat structure 16 is pressed downwardly to pass the finger portions 22*b* of one of the tower structures 22 through an aperture 14*f* in the end piece 14, pass the finger portions 22*b* of a further tower structure 22 through an aperture 14*g* in the same end piece 14, pass the finger portions 22*b* of a further tower structure 22 through aligned apertures 14*h* in a tongue 14*b* and 13*d* in an upper outboard end of a main slat 13, and pass the finger portions 22*b* of a further tower structure 22 through aligned apertures 14*i* in a tongue 14*b* and 13*e* in an upper outboard end of another main slat 13.

The other slat structure 16 (i.e., the lower slat structure 16) is positioned over the seam 26 shown in FIG. 2 formed between the inboard edge 14*c* of the lower end piece 14 and the lower end edges of the main slats 13. Referring back to FIG. 3, the cross slat structure 16 is pressed downwardly to pass the finger portions 22*b* of a tower structure 22 through an aperture 14*j* in the end piece 14, pass the finger portions 22*b* of a further tower structure 22 downwardly through an aperture 14*k* in the same end piece 14, pass the finger portions 22*b* of a further tower structure 22 downwardly through aligned apertures 14*l* in a tongue 14*b* and 13*f* in a lower outboard end a main slat 13, and pass the finger portions 22*b* of a further tower structure 22 downwardly through aligned apertures 14*m* in a tongue 14*b* and 13*g* in a lower outboard end of another main slat 13.

Figure 9:
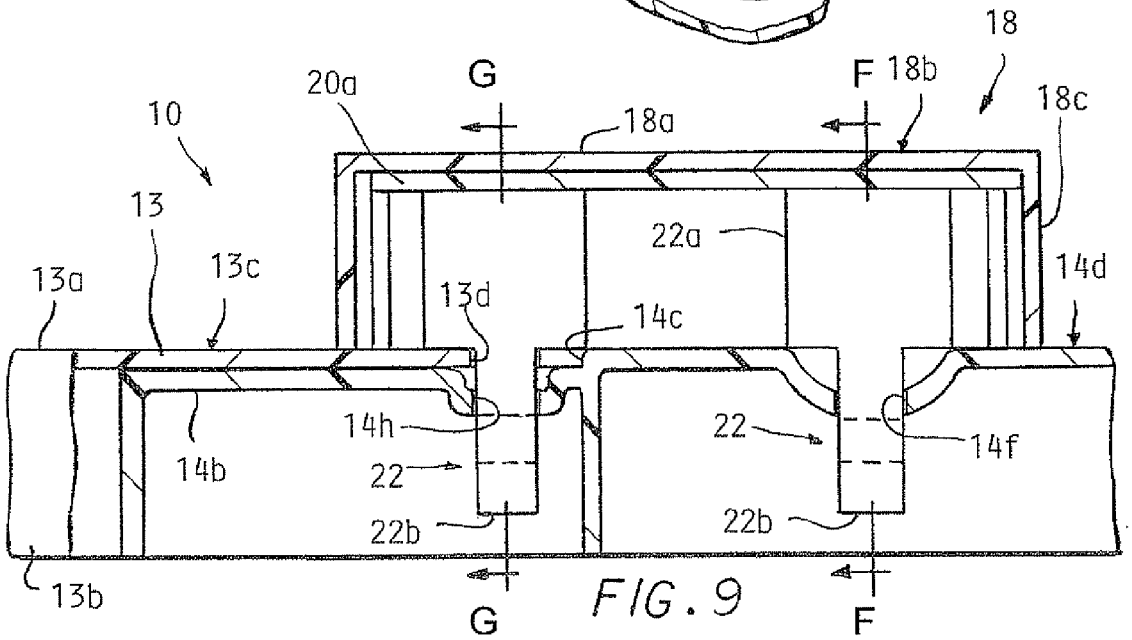
FIG. 9 is a fragmentary cross-sectional view taken on line B-B of FIG. 1.
Figure 10:
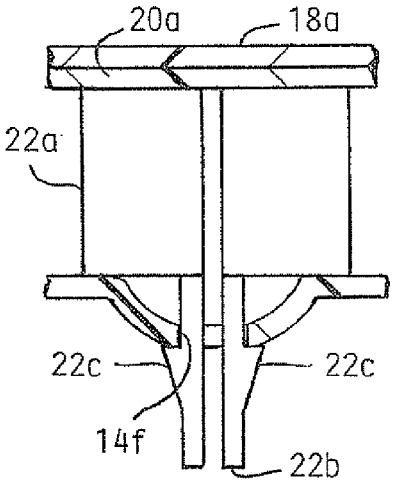
FIG. 10 is a fragmentary cross-sectional view taken on line F-F of FIG. 9.
Figure 11:
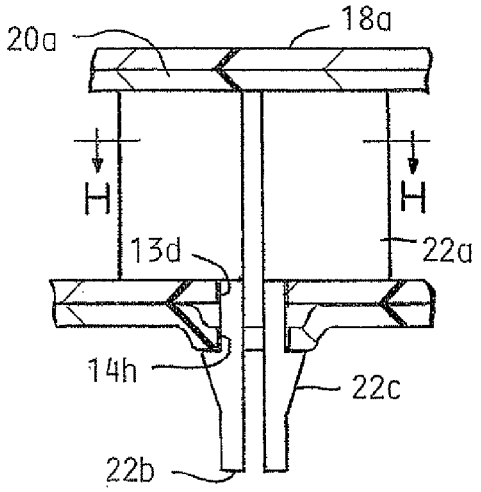
FIG. 11 is a fragmentary cross-sectional view taken on line G-G of FIG. 9.

As best seen in FIGS. 9-11, as the finger portions 22*b* of a tower structure 22 are passed downwardly through an aperture 14*f* or apertures 13*d* and 14*h*, the respective tower members 22*a* seat around the upper periphery of the aperture 14*f* or apertures 13*d* and 14*h*. The finger portions 22*b* are biased inwardly to allow passage of the latch portions 22*c* through the aperture 14*f* or apertures 13*d* and 14*h* whereafter the finger portions 22*b* spring outwardly to allow latch portions 22*c* to engage the under face of the aperture 14*f* or apertures 13*d* and 14*h*. The cross slat structures 16 are thereby removably mounted on the end pieces 14 and on the main slats 13.

In order to allow the latch portions 22*c* to firmly latch the cross slat structure 16 to the end piece 14 and to the main slats 13 both with respect to the single wall thickness encountered in the FIG. 10 scenario and with respect to the double wall thickness encountered in the FIG. 11 scenario, the apertures 14*f*, 14*g*, 14*k* and 14*j* and the apertures 14*h*, 14*i*, 14*l* and 14*m* can be formed in a countersunk portion of the associated end pieces 14.

Figure 12:
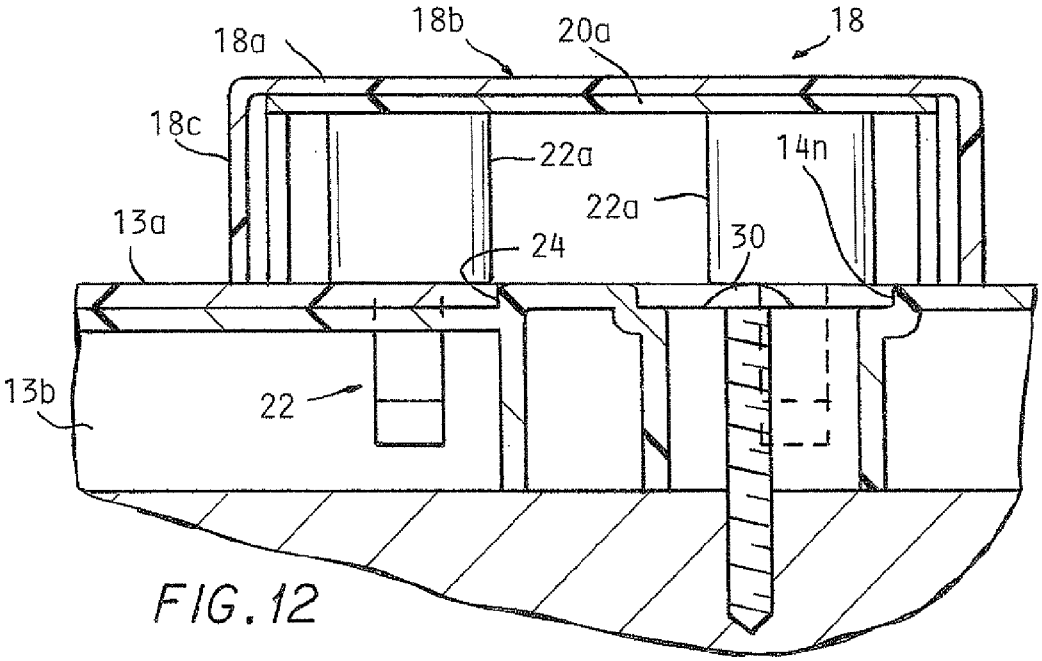
FIG. 12 is a fragmentary cross-sectional view taken on line C-C of FIG. 1.
Figure 14:
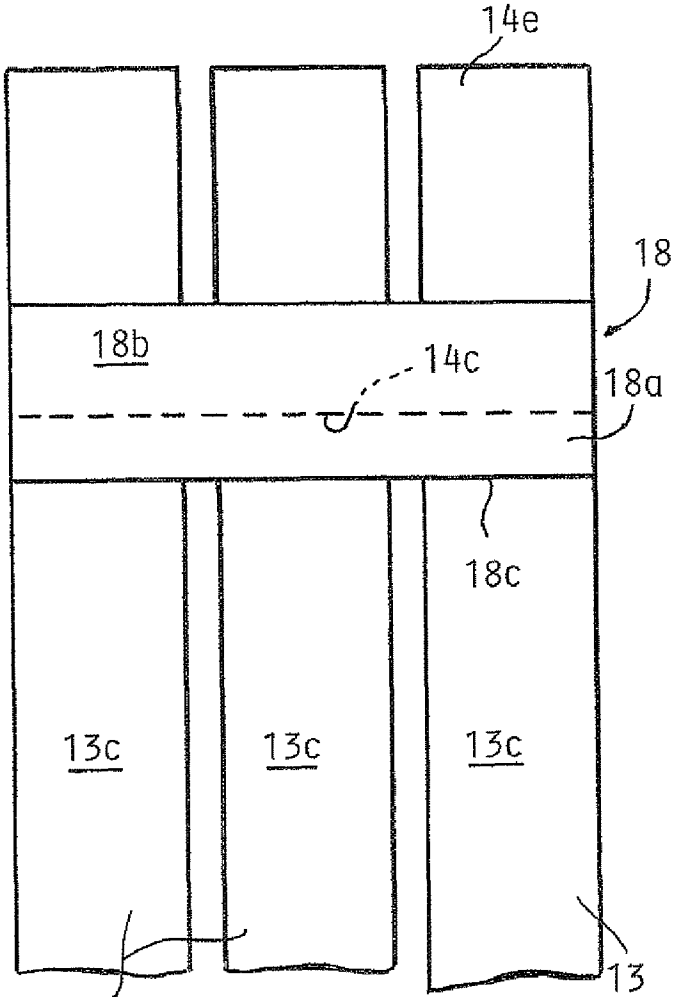
FIGS. 13 and 14 are fragmentary plan views illustrating the manner in which the cross slat structures of the shutter assembly of FIG. 1 conceal the fastener members utilized to mount the shutter assembly on a building surface.
Figure 13:
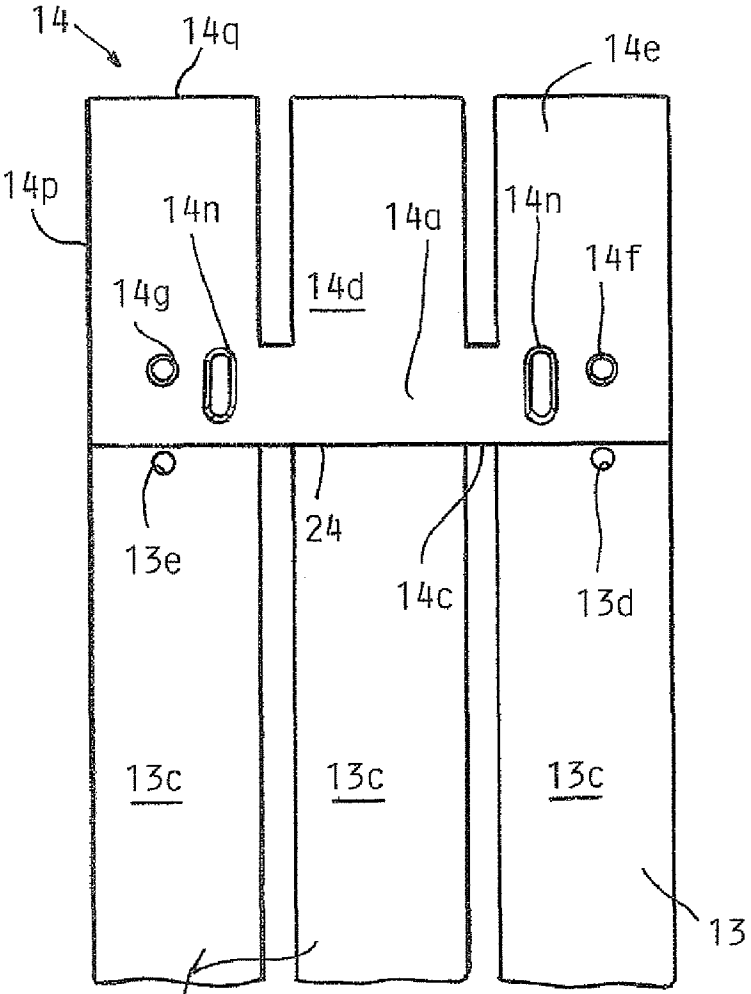

In use and as best seen in FIGS. 13 and 14, the shutter assembly 10 can be delivered to a building site with the cross slat structures 16 removably secured to the end pieces 14 and to the main slats 13 to form a total shutter assembly 10. At the site, the cross slat structures 16 can be removed from the end pieces 14 and the main slats 13 by squeezing the fingers 22*b* together to allow the latch portions 22*c* to be withdrawn upwardly through the apertures (e.g., aperture 14*f* or apertures 13*d* and 14*h*). Thereafter the shutter assembly 10, without the cross slat structures 16, may be positioned against the building surface 11 and screws 30 shown in FIG. 12 may be passed through slots 14*n* shown in FIGS. 3 and 12 provided in the main body sections 14*a* of the end pieces 14. Slots 14*n* extend vertically to allow vertical adjustment of the shutter assembly 10 with respect to the building surface 11, and the slots 14*n* can be countersunk as seen in FIG. 12 to position the head of the screw 30 below the upper face of the end pieces 14. Following installation of the shutter 10 on the building utilizing the screws 30, the cross slat structures 16 may be reinstalled utilizing tower structures 22. It will be seen that in the reinstalled positions, the cross slat structures 16 overlie and conceal the fastener members 30 as well as the seams 24 and 26 between the end pieces 14 and the main slats 13.

Figure 18:
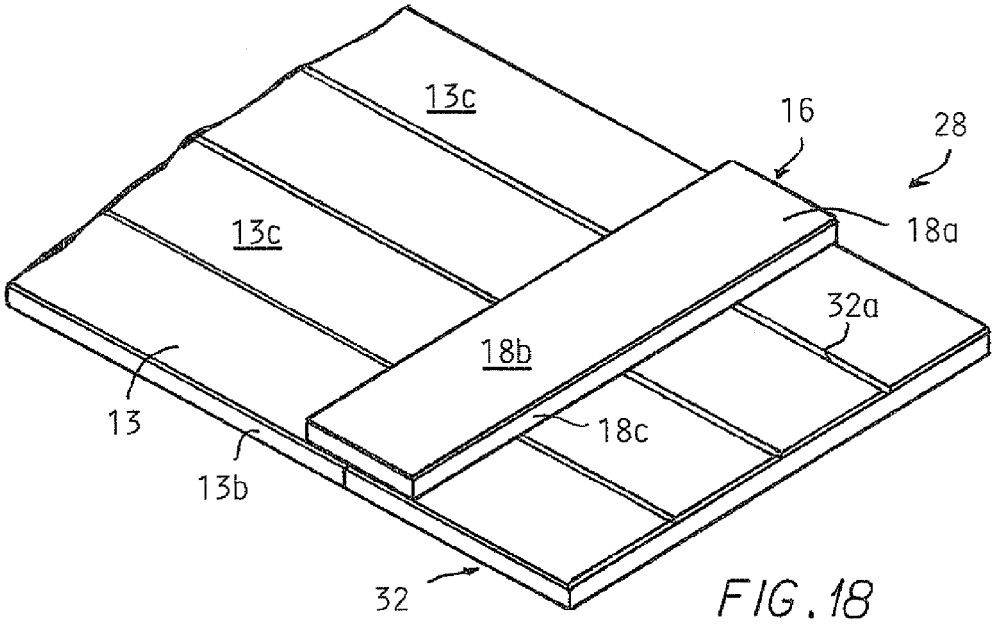
FIG. 18 is a fragmentary perspective view of an alternate example of a shutter assembly.
Figure 19:
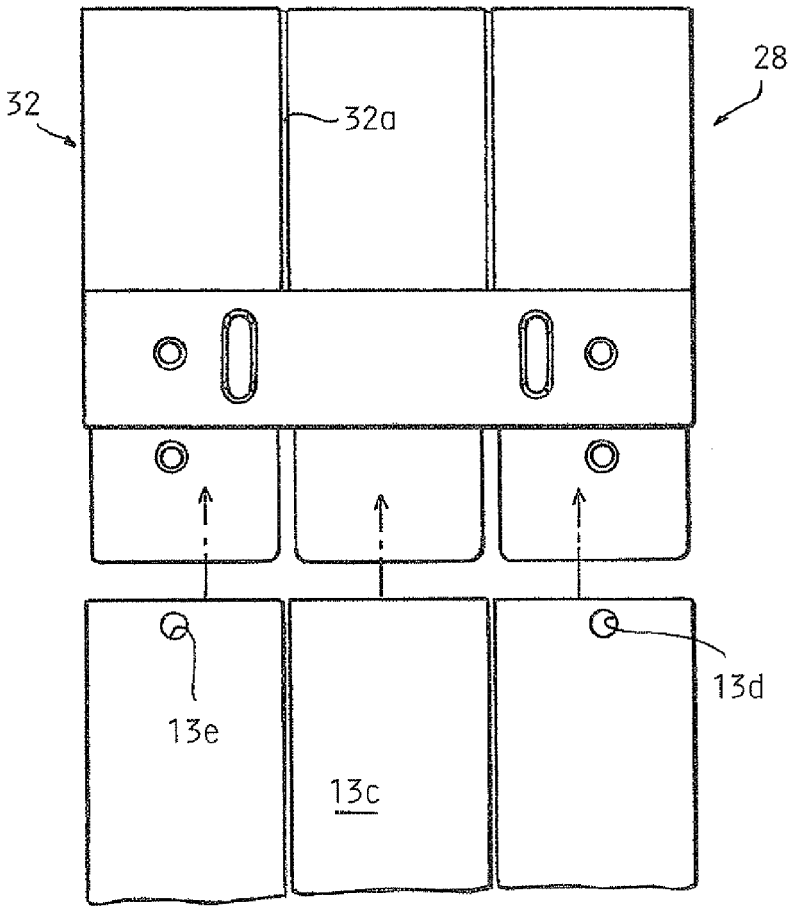
FIG. 19 is a fragmentary exploded view of the alternate example of FIG. 18.

Another example of a shutter assembly 28 as seen in FIGS. 18 and 19 is generally similar to the shutter assembly 10 of FIGS. 1-17 with the exception the shutter assembly 28 includes end pieces 32 instead of end pieces 14. Each end piece 32 is formed as a unitary structure rather than being split to form separate end slat portions 14*e* as is the case with end pieces 14 described previously. The appearance of individual slats is simulated by forming parallel laterally spaced grooves 32*a* opening in the decorative surface of the end piece 32 and aligning respectively with seams formed between the main slats 13 which, in this embodiment, are substantially contiguous rather than being laterally spaced, as in the FIGS. 1-17 embodiment.

The decorative shutter assemblies 10 and 28 as described herein will be seen to provide a shutter assembly that can be inexpensively manufacturable, easily installed, and in which all fastener members fastening the shutter structure to a building surface can be totally concealed.

While the shutter assemblies 10 and 28 have been described in connection with what is presently considered to be the most practical examples, it is to be understood that the invention is not to be limited to the disclosed examples but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A decorative shutter assembly comprising:

a plurality of laterally spaced main slats arranged parallel to each other in side-by-side relation and each presenting a decorative surface and defining an open end at each end of the slat;

a first end piece positioned at one end of the main slats; and a second end piece positioned at an opposite end of the main slats;

each end piece including a main body section having a width approximating an overall width of the side-by-side slats and a plurality of laterally spaced tongues projecting from an inboard end of the main body section, the main body section defining end slat portions comprising separate laterally spaced slat portions aligning respectively with the laterally spaced main slats;

the main body section of each end piece presenting a decorative surface;

the tongues being spaced and sized to fit in the respective open ends of the main slats at a respective end of the main slats with the decorative surfaces of the main body section positioned flush with the decorative surfaces of the main slats to form a continuous, flat decorative surface extending from end to end of the shutter.

2. A decorative shutter assembly according to claim 1 wherein the main slats are substantially contiguous and the end slat portions of each end piece are defined by parallel, laterally spaced grooves opening in the decorative surface of the main body section and aligning respectively with seams formed between the substantially contiguous main slats to create the appearance of slats extending from end-to-end of the shutter.

3. A decorative shutter assembly according to claim 1 wherein the shutter assembly further includes first and second cross slat structures with each cross slat structure secured to a respective main body section of an end piece and to respective ends of the main slats in overlying relation to a seam formed between the inboard end of the main body section and the respective ends of the main slats.

4. A decorative shutter assembly according to claim 3 wherein each cross slat structure includes a cross slat having a U-shaped cross-sectional configuration including a first side flange portion positioned against the respective ends of the main slats, a second side flange portion positioned against the main body section of the respective end piece, and a main body portion spaced above the decorative surfaces of the main slats and the decorative surface of the main body section of the end piece and presenting a decorative surface complementary to the decorative surfaces presented by the main slats and the main body section of the end piece.

5. A decorative shutter assembly according to claim 4 wherein each main slat has a U-shaped cross sectional configuration including a main body portion presenting the decorative surface and side flange portions projecting rearwardly from the main body portion and coacting with the main body portion to define the open end at each end of the slat.

6. A decorative shutter assembly according to claim 5 wherein:

the main body section of each end piece includes a main body portion presenting the decorative surface and side flange portions projecting rearwardly from the main body portion;

with the tongues fitted in the respective open ends of the main slats, an outboard side flange of an outboard main slat aligns with the side flanges of the end pieces to constitute continuous side flanges extending from end to end of the shutter.

7. A decorative shutter assembly according to claim 4 wherein each cross slat structure further includes a plurality of spaced fastener pins extending rearwardly from the main body portion of the cross slat and engaging the main body portion of the respective end piece and the respective ends of the main slats to connect the end pieces to the main slats.

8. A decorative shutter assembly according to claim 7 wherein the plurality of fastener pins of each cross slat structure includes a plurality of laterally spaced fastener pins coacting with laterally spaced apertures in the main body portion of the respective end piece and a further plurality of laterally spaced fastener pins coacting with apertures in the ends of laterally spaced main slats and with aligned apertures in laterally spaced tongues received in the laterally spaced main slats.

9. A decorative shutter assembly according to claim 7 wherein:

each cross slat has open ends; and each cross slat structure further includes end caps fixedly positioned in the open ends of the cross slat and defining the fastener pins.

10. A decorative shutter assembly comprising:

a plurality of main slats arranged parallel to each other in side-by-side relation and each presenting a decorative surface and defining an open end at each end of the slats;

a first end piece positioned at one end of the main slats;

a second end piece positioned at an opposite end of the main slats; and first and second cross slat structures;

each end piece including a main body section having a width approximating an overall width of the side-by-side slats and a plurality of laterally spaced tongues projecting from an inboard end of the main body section;

the main body section of each end piece presenting a decorative surface;

the tongues being spaced and sized to fit in the respective open ends of the main slats at a respective end of the main slats to form a seam between the inboard end of the main body section and the respective ends of the main slats with the decorative surfaces of the main body sections positioned flush with the decorative surfaces of the main slats to form a continuous, flat decorative surface extending from end to end of the shutter;

each cross slat structure being secured to a respective main body section of an end piece and to respective ends of the main slats in overlying relation to the seam.

11. A decorative shutter assembly according to claim 10 wherein:

the main body section of each end piece defines end slat portions aligning respectively with the side-by-side main slats.

12. A decorative shutter assembly according to claim 11 wherein the main slats are substantially contiguous and the end slat portions of each end piece are defined by parallel, laterally spaced grooves opening in the decorative surface of the main body section and aligning respectively with seams formed between the substantially contiguous main slats to create the appearance of slats extending from end-to-end of the shutter.

13. A decorative shutter assembly according to claim 11 wherein:

the main slats are laterally spaced; and the end slat portions of each end piece comprise separate, laterally spaced slat portions aligning respectively with the laterally spaced main slats.

14. A decorative shutter assembly according to claim 11 wherein each main slat includes a main body portion presenting the decorative surface and side flange portions projecting rearwardly from the main body portion and coacting with the main body portion to define the open end at each end of the slat.

15. A decorative shutter assembly according to claim 14 wherein:

the main body section of each end piece includes a main body portion presenting the decorative surfaces and side flange portions projecting rearwardly from the main body portion; and with the tongues fitted in the respective open ends of the main slats an outboard side flange of an outboard main slat aligns with the side flanges of the end pieces to constitute continuous side flanges extending from end to end of the shutter.

16. A decorative shutter assembly according to claim 10 wherein each cross slat structure includes a cross slat and a plurality of spaced fastener pins extending rearwardly from the cross slat and engaging the main body section of the respective end piece and the respective ends of the main slats to connect the end pieces to the main slats.

17. A decorative shutter assembly according to claim 16 wherein the plurality of fastener pins of each cross slat structure includes a plurality of laterally spaced fastener pins coacting with laterally spaced apertures in the main body section of the respective end piece and a further plurality of laterally spaced fastener pins coacting with apertures in the ends of laterally spaced main slats and with aligned apertures in laterally spaced tongues received in the laterally spaced main slats.

18. A decorative shutter assembly according to claim 16 wherein each cross slat has a U-shaped cross-sectional configuration including a first side flange portion positioned against the respective ends of the main slats, a second side flange portion positioned against the main body section of the respective end piece, and a main body portion spaced above the decorative surfaces of the main slats and the decorative surface of the main body section of the end piece and presenting a decorative surface complementary to the decorative surfaces presented by the main slats and the main body section of the end piece.

19. A decorative shutter assembly according to claim 18 wherein:

each cross slat has open ends; and each cross slat structure further includes end caps fixedly positioned in the open ends of the cross slat and defining the fastener pins.

20. A decorative shutter assembly comprising:

a plurality of main slats arranged parallel to each other in side-by-side relation and each having a U-shaped cross-sectional configuration including a main body portion presenting a decorative surface and side flange portions projecting rearwardly from the main body portion and coacting with the main body portion to define an open end at each end of the slat;

a first end piece positioned at one end of the main slats; and a second end piece positioned at an opposite end of the main slats;

each end piece including a main body section defining end slat portions aligning respectively with the side-by-side main slats, each main body section having a width approximating an overall width of the side-by-side slats and a plurality of laterally spaced tongues projecting from an inboard end of the main body section;

the main body section of each end piece including a main body portion presenting a decorative surface and side flange portions projecting rearwardly from the main body portion;

the tongues being spaced and sized to fit in the respective open ends of the main slats at a respective end of the main slats with the decorative surfaces of the end piece main body sections positioned flush with the decorative surfaces of the main slats to form a continuous, flat decorative surface extending from end to end of the shutter and with an outboard side flange of an outboard main slat aligning with the side flanges of the main body section of the end pieces to constitute continuous side flanges extending from end-to-end of the shutter.

21. A decorative shutter assembly according to claim 20 wherein the main slats are substantially contiguous and the end slat portions of each end piece define parallel, laterally spaced grooves opening in the decorative surface of the main body section and aligning respectively with seams formed between the substantially contiguous main slats to create the appearance of slats extending from end-to-end of the shutter.

22. A decorative shutter assembly according to claim 20 wherein:

the main slats are laterally spaced; and the end slat portions of each end piece comprise separate laterally spaced slat portions aligning respectively with the laterally spaced main slats.

23. A decorative shutter assembly according to claim 20 wherein the shutter further includes first and second cross slat structures with each cross slat structure secured to a respective main body section of an end piece and to respective ends of the main slats in overlying relation to a seam formed between the inboard end of the main body section and the respective ends of the main slats.

24. A decorate shutter assembly according to claim 23 wherein each cross slat structure includes a cross slat having a U-shaped cross-sectional configuration including a first side flange portion positioned against the respective ends of the main slats, a second side flange portion positioned against the main body section of the respective end piece, and a main body portion spaced above the decorative surfaces of the main slats and the decorative surface of the main body section of the end piece and presenting a decorative surface complementary to the decorative surfaces presented by the main slats and the main body section of the end piece.

25. A decorative shutter assembly according to claim 24 wherein the plurality of fastener pins of each cross slat includes a plurality of laterally spaced fastener pins coacting with laterally spaced apertures in the main body section of the respective end piece and a further plurality of laterally spaced fastener pins coacting with apertures in the ends of laterally spaced main slats and with aligned apertures in laterally spaced tongues received in the laterally spaced main slats.

26. A decorative shutter assembly according to claim 23 wherein each cross slat structure further includes a plurality of spaced fastener pins extending rearwardly from the main body portion of the cross slat and engaging the main body section of the respective end piece and the respective ends of the main slats to connect the end pieces to the main slats.

27. A decorative shutter assembly according to claim 26 wherein:

each cross slat has open ends; and each cross slat structure further includes end caps fixedly positioned in the open ends of the cross slat and defining the fastener pins.

28. A decorative shutter assembly including a vertical structure and a plurality of cross slats extending laterally across the vertical structure, characterized in that:

the vertical shutter structure includes fastener apertures to pass fastener members to secure the vertical shutter structure to a building surface;

the cross slats extend laterally across the vertical shutter structure in overlying and concealing relation to the fastener members; and coacting fastener structures on the vertical shutter structure and on the cross slats operative to removably secure the cross slats to the vertical shutter structure whereby to allow removal of the cross slats to allow passage of the fastener members through the apertures to attach the vertical shutter structure to the building surface followed by reattachment of the cross slats to the vertical shutter structure to conceal the fastener members.

29. A decorative shutter assembly according to claim 28 wherein the coacting fastener structures include resilient pins on the cross slats and pin apertures in the vertical shutter structure.

30. A decorative shutter assembly according to claim 29 wherein the fastener apertures comprise vertically extending slots to provide adjustment in the mounting of the vertical shutter structure on the building surface.

* * * * *

UNITED STATES PATENT AND TRADEMARK OFFICE

CERTIFICATE OF CORRECTION

PATENT NO. : 8,341,912 B2
APPLICATION NO. : 12/361559
DATED : January 1, 2013
INVENTOR(S) : Donald Verna It is certified that error appears in the above-identified patent and that said Letters Patent is hereby corrected as shown below:

First Page, insert -- (73) Assignee: Alpha Systems, LLC, Elkhart, Indiana --

Signed and Sealed this
Twelfth Day of March, 2013

Teresa Stanek Rea
*Acting Director of the United States Patent and Trademark Office*